US006814669B1

(12) United States Patent
Marcinkowska

(10) Patent No.: US 6,814,669 B1
(45) Date of Patent: Nov. 9, 2004

(54) DUAL SURFACE FOR SPORT EVENT OR GAME

(76) Inventor: Renata Marcinkowska, 1752 Kallaramo Rd., Rock Hill, SC (US) 29732

( * ) Notice: Subject to any disclaimer, the term of this patent is extended or adjusted under 35 U.S.C. 154(b) by 0 days.

(21) Appl. No.: 10/414,968

(22) Filed: Apr. 16, 2003

(51) Int. Cl.[7] ..... A63C 19/04
(52) U.S. Cl. ..... 472/92; 472/94; 473/459
(58) Field of Search ..... 472/92, 94; 473/459, 473/473, 474; 434/247, 251, 252

(56) References Cited

U.S. PATENT DOCUMENTS 3,980,299 A * 9/1976 Brown ..... 473/474
4,045,022 A * 8/1977 Grant et al. ..... 473/474
5,709,620 A * 1/1998 Reinprecht ..... 473/459
6,077,176 A * 6/2000 Poshadlo, Jr. ..... 473/474

FOREIGN PATENT DOCUMENTS

GB 2 233 565 * 1/1991

* cited by examiner

*Primary Examiner*—Kien Nguyen
(74) *Attorney, Agent, or Firm*—Nash & Titus, LLC

(57) ABSTRACT

A hybrid tennis court with one type of surface applied to one side of the net from the net to the back fence and a different type of surface applied to the other side of the net from the net to the back fence. A hybrid court is useful as a teaching tool, for exhibitions, for injured players, and for adding a new dimension to the game of tennis. Also included in this invention is a golf course with two or more different types of surfaces used on different putting greens or a putting green with two ore more different types of surfaces on the same green or different types of surfaces on different fairways.

5 Claims, 2 Drawing Sheets

DUAL SURFACE FOR SPORT EVENT OR GAME

BACKGROUND OF THE INVENTION

1. Field of the Invention

The present invention relates a hybrid tennis court wherein multiple types of surfaces are present on a single court. The presence of multiple surfaces adds interest and difficulty to play and is also useful as a training tool for athletes that must be proficient on different types of surfaces.

2. Brief Description of Related Art

For the sport of tennis, past courts have been composed of a single type of surface. Standard surfaces are clay, Har-Tru®, hard court and grass. Players on both sides of the court have both played on the same type of surface during a game whether it is a hard court or grass, etc. For instance, we have various tennis tournaments on clay, gras, hard courts, artificial clay and carpet. Grand Slam tournaments are on clay, grass and hard courts of various types. Both side of the court play exactly the same. Each type of surface plays differently, however.

Clay courts, both red and green are generally slower than other surfaces. Har-Tru® courts are also generally very slow. Har-Tru® is a surface that is composed of granular particles. Hard courts, such as asphalt and concrete are generally faster than clay or Har-Tru® courts. Some hard courts have rubberized surfaces which makes the ball rebound very quickly. Grass courts and artificial grass courts are generally very fast. Carpet, which is usually used indoors is generally fast. Each type of surface provides its own set of challenges. Some players are very good on one surface but not good on other surfaces. Some players have difficulty making the adjustment from one surface to another. If a player is use to clay and goes to another court such as grass, they will feel surprised at how much faster the ball travels after a bounce on the grass court and it can affect their sense of timing.

As a result of so many different types of court surfaces, competitive players must practice on all the different types to be able to compete in different tournaments. Recreational players may also need to practice on several different types of surfaces to be able to play confidently upon switching venues.

Because most tennis clubs and parks usually only offer one type of court surface, a tennis player has to travel to different venues to seek to play on different types of surfaces. If the player wishes to have an instructor, the instructor must also travel or the player will have to use multiple instructors to learn the different types of surfaces and how they play.

With the ever-growing number of people that are playing tennis competitively on multiple types of court surfaces, there is a need for a hybrid court with two types of surfaces on the same court. Such a court would be useful for training purposes, recreational purposes and entertainment purposes. A hybrid tennis court is a tennis court wherein one side of the court from the back fence to the net is one type of surface, and the other side of the court from the net to the back fence is a different type of surface.

Right now majorities of people take lessons on hard or clay courts. So in reality clubs generally use 2 courts for lessons. A hybrid court like a clay/hard court would eliminate the need for an extra court. If a person wants a lesson on a clay court the pro puts the player on a clay surface and goes himself/herself onto a hard side of the court or if a person prefers a lesson on a hard court the pro puts him/her there and ventures into the clay court side. Basically in this situation the hybrid court kills two birds with one stone.

For example, two juniors are going to separate tournaments. One is playing an event on clay and the other on a hard court, until now they would have to either designate extra work outs so that they can hit on both surfaces or find different partners to hit with. The hybrid court would eliminate those problems, because they can hit with each other at the same time on the right surfaces.

People that are injured (like with knee problems) must play on soft courts like clay and Har-Tru®. These people could still play matches against their opponents and enjoy the moment. A lot of players that get injured and are used to playing on hard court quit because their friends don't want to venture onto clay courts. On a hybrid court the injured player can stay on a clay court side while their healthy opponents can still be on hard. In some places that have grass courts (mostly up north) a grass court/hard court combination would also do the trick.

The hybrid court would help with sparking the interest of the senior players wanting to hit with younger opponents. The seniors, who generally prefer clay, could have great matches vs. young adults who generally prefer hard courts. There may be a greater interest in the Father/Son or Mother/Daughter matches.

The hybrid court would be the most difficult surface to play tennis on. It would help with teaching a proper technique, survival skills, concentration, good footwork and adaptability among other things. It would move tennis to a new level.

In a hybrid court tournament, a new surface would be created and probably even a new category. A hybrid court would require technical skills, concentration, mental ability, versatility and creative footwork to be able to adjust to playing a match on a hybrid court. Every two games or so a player would have to adjust to a different surface. It would create most difficult tournaments in the world and a new challenge for the players. Perhaps a big tournament may consider the hybrid surface as their playing surface, and this way create a 5-th Grand Slam Tournament of the year.

A hybrid court would add much interest to watching major tournaments where such courts were in use. Imagine watching a French Open and a US Open Champions playing a match on a hybrid court. In one type of exhibition match, a clay court specialist stays on a clay side and a hard court specialist on his favorite surface. In another type of exhibition match, the player could also play the match switching sides to see who can adapt to both surfaces quicker and is in reality a better, more versatile player. This type of exhibition would create a much-needed excitement for general public and would certainly help with promoting tennis.

Therefore, an object of the present invention is to provide a tennis court that would create a new game category.

Another object of the present invention is to provide a tennis court that has a dual surface for more interesting exhibition matches.

Another object of the present invention is to provide a tennis court that is a teaching tool for learning different types of surfaces.

Another object of the present invention is to provide a tennis court that permits a tennis player the ability to practice on two different types of surfaces at the same location.

Another object of the present invention is to provide a tennis court that permits injured players to play on a softer surface such as clay with another player that prefers to play on a harder court such as asphalt.

Briefly, these objects and other objects of the present invention as hereinafter will become more readily apparent can be attained by a hybrid court with a different type of surface on each side of the net.

SUMMARY OF THE INVENTION

A tennis court of the present invention has a center net a different type of surface on each side of the net. The tennis court has a first surface of one type of material on one side of the net and a second surface of different type of material on the other side of the net.

DETAILED DESCRIPTION

Figure 1:
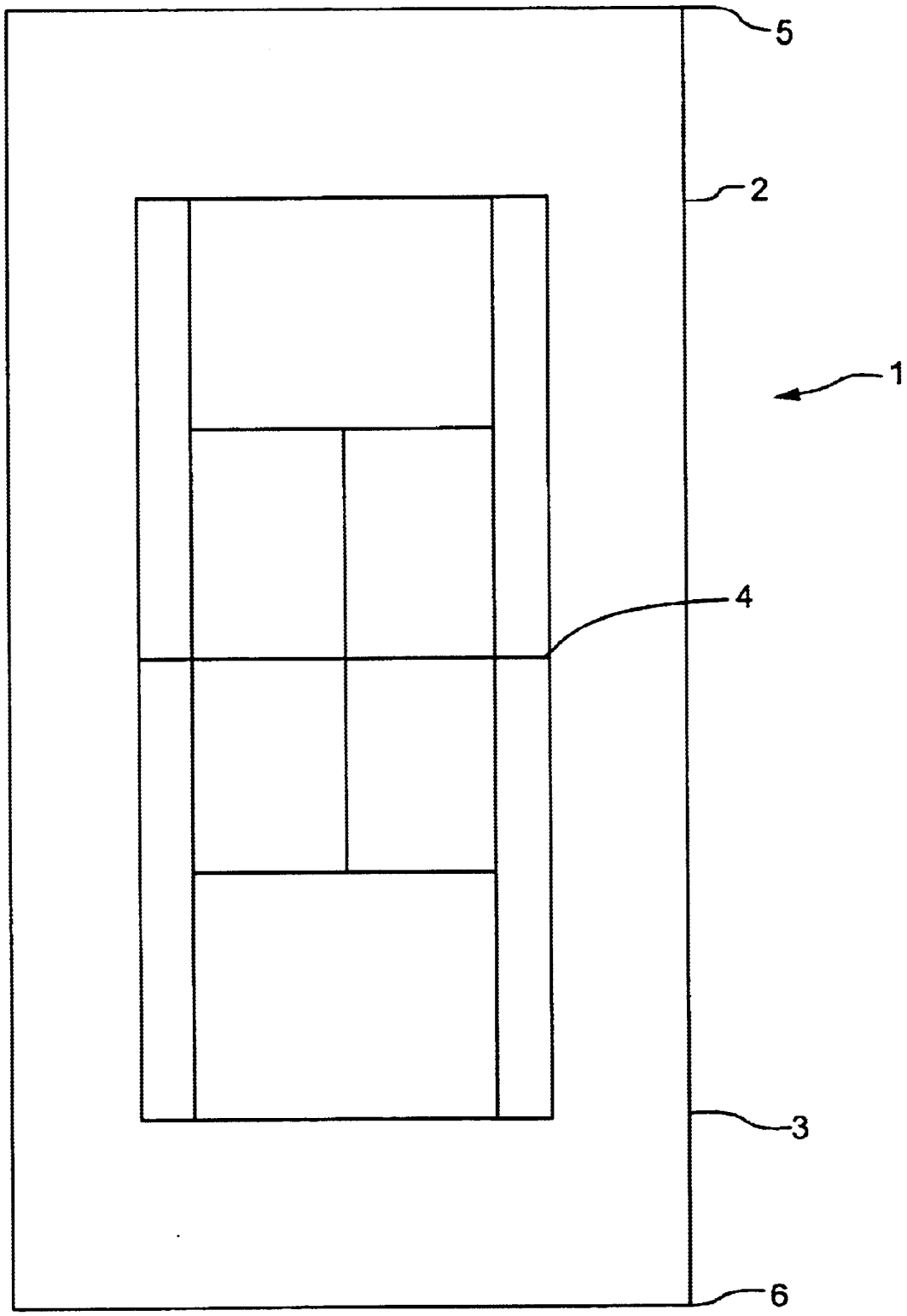
FIG. 1 is a top view of a tennis court according to the present invention.

The present invention is directed to a hybrid tennis court. As shown in FIG. 1, a hybrid tennis court 1 is a tennis court with at least two different types of surfaces thereon. From the back fence 5 to the net 4 on one side of the court is a first surface 2 and from the back fence 6 to the net 4 on the other side is a second surface 3. The term back fence can be substituted with back end. Not all tennis courts have a fence at the back end but all tennis courts have back ends on opposing sides.

The types of surfaces that are contemplated for use in any combination are clay, artificial clay such as fast dry or Har-Tru®, hard court, carpet and grass. Carpet courts include Club 40®, OmniCourt®, Tennis Turf®, and Master Turf®. Many carpet courts are sand-filled synthetic grass. Hard courts include asphalt, concrete, rubber coated asphalt or rubber coated concrete courts. Some courts are cushioned. A brand name for a cushiond hard court is DecoTurf®. Any other type of surface that is available for a tennis court is also contemplated for a hybrid court of the present invention.

Figure 2:
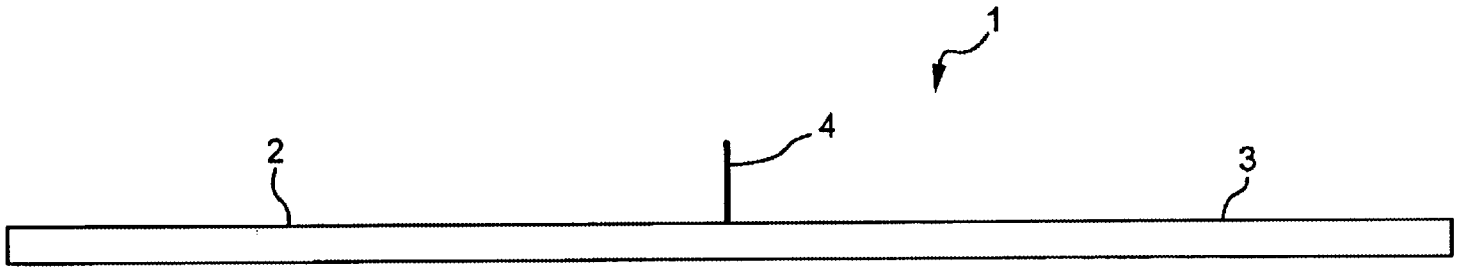
FIG. 2 is a side view of the tennis court of the invention according to one embodiment.
Figure 3:
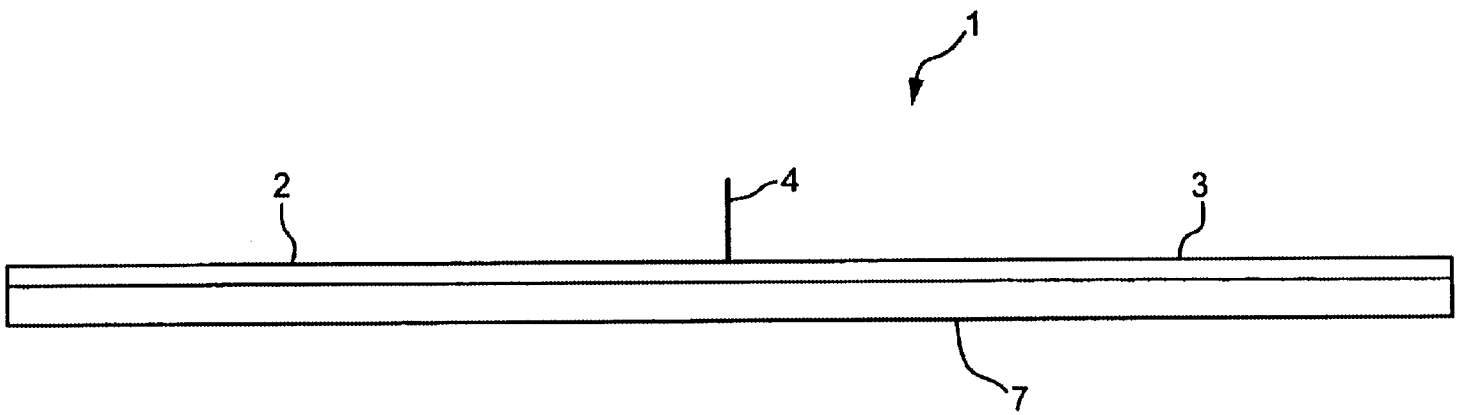
FIG. 3 is a side view of the tennis court of the invention according to another embodiment of the invention.

When the court is constructed, the contractor applies different surfaces on opposite sides of the net. As shown in FIG. 2, two different types of upper surfaces 2 and 3 are present on opposing sides of the net 4. Alternatively, two different types of surfaces 2 and 3 can be applied over the top of a base surface 7 as shown in FIG. 3.

All other features of regulation or standard tennis courts such lines, nets, measurements and dimensions are the same as found on regulation or standard tennis courts as known in the sport.

In another embodiment of the invention, this concept of dual surfaces can be applied to other sports such as, for example, golf. A golf green and/or fairway can be made of two or more different types of surfaces wherein one surface is very fast and the other surface is slower. Different types of grasses can be used on the same green and/or fairway to achieve this result or different cutting heights of the grass can be present on different areas of the green. Additionally, the present invention also contemplates one type of surface on one green and a different type of surface on another green with at least two different types of surfaces used for greens on a given course.

Any other sport is also contemplated by this invention wherein adding different surfaces as a variable to play would result in a different dimension in the game.

Having generally described this invention, a further understanding can be obtained by reference to certain specific examples that are provided herein for purposes of illustration only and are not intended to be limiting unless otherwise specified.

EXAMPLES

1. A tennis court is constructed with clay on one side of the net from the net to the back fence and a carpet from the net to the back fence on the other side.

2. Another example of a hybrid court is a court constructed with clay on one side from the net to the back fence and hard court from the net to the back fence on the other side.

3. Another example of a hybrid court is a court that is constructed with clay on one side from the net to the back fence and a Har-Tru® surface from the net to the back fence on the other side.

4. Another example of a hybrid court is a court that is constructed with clay on one side from the net to the back fence and a grass surface from the net to the back fence on the other side.

5. Another example of a hybrid court is a court that is constructed with carpet on one side from the net to the back fence and a hard court surface from the net to the back fence on the other side.

6. Another example of a hybrid court is a court that is constructed with carpet on one side from the net to the back fence and a Har-Tru® surface from the net to the back fence on the other side.

7. Another example of a hybrid court is a court that is constructed with carpet on one side from the net to the back fence and a grass surface from the net to the back fence on the other side.

8. Another example of a hybrid court is a court that is constructed with a hard surface on one side from the net to the back fence and a Har-Tru® surface from the net to the back fence on the other side.

9. Another example of a hybrid court is a court that is constructed with a hard surface on one side from the net to the back fence and a grass surface from the net to the back fence on the other side.

10. Another example of a hybrid court is a court that is constructed with Har-Tru® on one side from the net to the back fence and a grass surface from the net to the back fence on the other side.

Having now fully described the invention, it will be apparent to one of ordinary skill in the art that many changes and modifications can be made thereto without departing from the spirit or scope of the invention as set for the herein.

What is claimed is:

1. A tennis court having a center net, said tennis court comprising: a first surface of one type of material on one side of the net and a second surface of different type of material on the other side of the net.

2. The tennis court of claim 1, wherein said first surface is from the net to a back end of the court and the second surface is from the net to a back end on the other side of the court.

3. The tennis court of claim 1, wherein each of said first surface and said second surface are selected independently from the group consisting of hard court, artificial clay, carpet, grass and clay.

4. The tennis court of claim 1, wherein said first surface and said second surface are laid on top of a base surface.

5. A tennis court comprising a center net, a first side on one side of the net and a second side on the other side of the net, the improvement comprising: a first surface of one type of material on said first side of the net and a second surface of a different type of material than said first surface on said second side of the net.

* * * * *